US005441784A

United States Patent [19]

Smith

[11] Patent Number: 5,441,784

[45] Date of Patent: Aug. 15, 1995

[54] PAPER BASE WALLCOVERINGS

[75] Inventor: John R. Smith, Gansevoort, N.Y.

[73] Assignee: Decora, Incorporated, Fort Edward, N.Y.

[21] Appl. No.: 222,286

[22] Filed: Apr. 4, 1994

[51] Int. Cl.[6] ..... D21H 27/20

[52] U.S. Cl. ..... 428/40; 40/594; 428/218; 428/219; 428/220; 428/352; 428/354; 428/355; 428/356; 428/447; 428/451; 428/484; 428/510; 428/514; 428/904.4; 428/906

[58] Field of Search ..... 428/40, 219, 220, 218, 428/343, 352, 354, 355, 356, 906, 904.4, 447, 451, 484, 510, 514; 40/594; 156/63

[56] References Cited

U.S. PATENT DOCUMENTS

| | | | |
|---|---|---|---|
| 3,607,540 | 9/1971 | Hoogstoel | 156/289 |
| 3,620,366 | 11/1971 | Parkinson et al. | 206/590 |
| 4,151,319 | 4/1979 | Sackoff et al. | 428/40 |
| 4,555,441 | 11/1985 | Rothenberg | 428/284 |
| 4,650,704 | 3/1987 | Rothenberg | 428/904.4 |
| 4,804,572 | 2/1989 | Bodrogi | 428/904.4 |

FOREIGN PATENT DOCUMENTS

| | | |
|---|---|---|
| 2079630 | 1/1985 | United Kingdom . |
| WO9306301 | 3/1993 | WIPO . |

*Primary Examiner*—Nasser Ahmad

*Attorney, Agent, or Firm*—Hedman, Gibson & Costigan

[57] ABSTRACT

This invention provides a paper based wallcovering having an optional decorative surface and coated on the back surface thereof with a moisture resistant, elastomeric barrier layer overcoated with a layer of a removable tacky pressure sensitive adhesive, the outwardly facing surface being coated with a moisture-resistant barrier coating of a synthetic resin composition having release properties. The pressure-sensitive adhesive coating and the synthetic resin are so chosen that the protective coating of the synthetic resin on the decorative surface acts as a release coat for the adhesive and the barrier layers are so chosen that the expansion and contraction of the paper substrate under the influence of environmental moisture is minimized and/or accommodated.

12 Claims, 1 Drawing Sheet

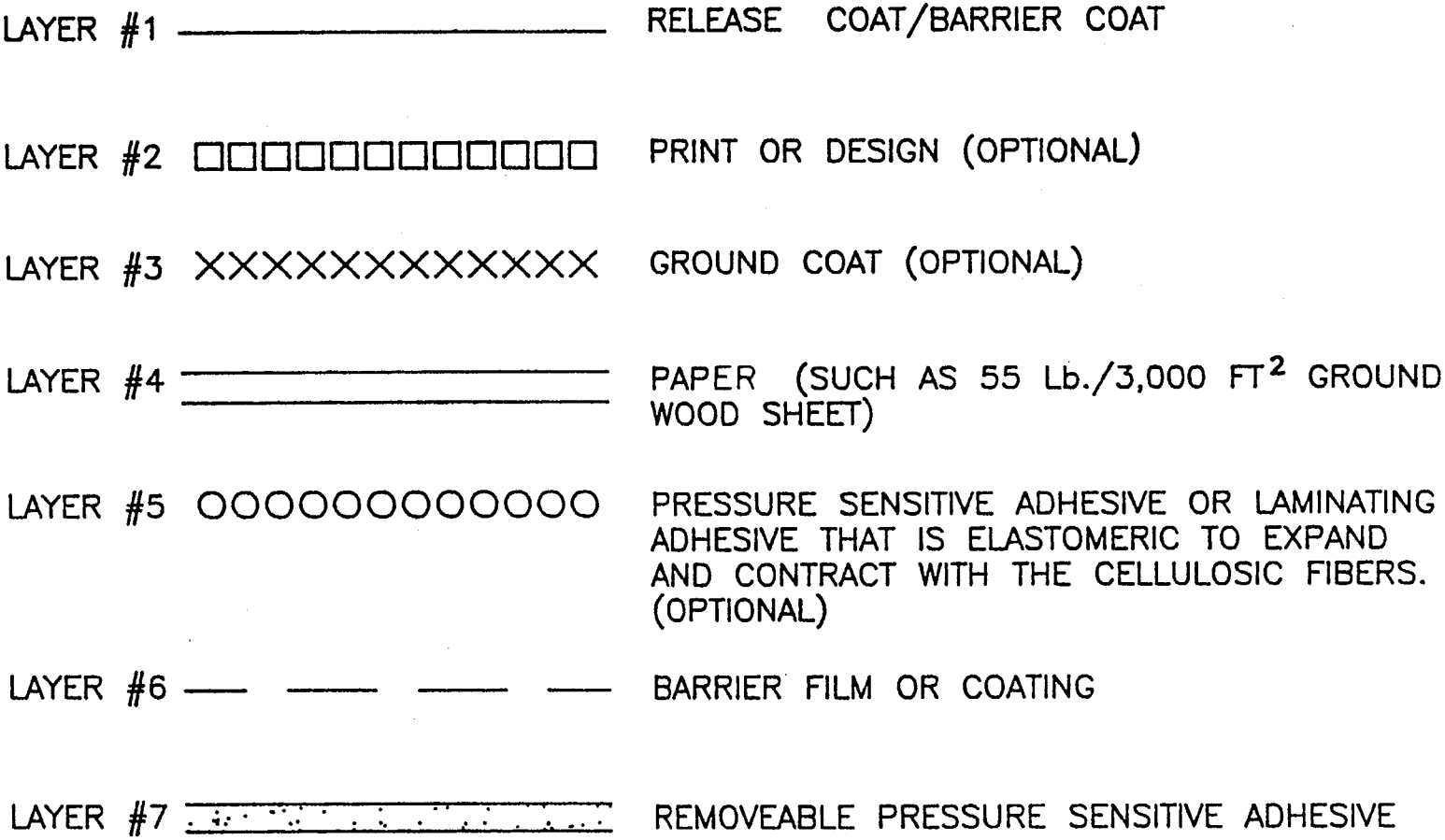
LAYER #1
RELEASE COAT/BARRIER COAT
LAYER #2
PRINT OR DESIGN (OPTIONAL)
LAYER #3
GROUND COAT (OPTIONAL)
LAYER #4
PAPER (SUCH AS 55 Lb./3,000 FT2 GROUND WOOD SHEET)
LAYER #5
PRESSURE SENSITIVE ADHESIVE OR LAMINATING ADHESIVE THAT IS ELASTOMERIC TO EXPAND AND CONTRACT WITH THE CELLULOSIC FIBERS. (OPTIONAL)
LAYER #6
BARRIER FILM OR COATING
LAYER #7
REMOVEABLE PRESSURE SENSITIVE ADHESIVE

PAPER BASE WALLCOVERINGS

This invention relates to novel paper based decorative wallcovering articles of manufacture characterized in that when affixed to a bonding substrate they offer very unique properties that are not presently available in the marketplace. More particularly the invention relates to paper substrates, including conventional wallpaper, that are well known in the market, but adapting them to decorating walls, ceilings, and the like, by using pressure sensitive adhesives and the like. In preferred embodiments, the invention provides wallcoverings in self-wound form, i.e., they can be unrolled and applied without the need to remove and discard a carrier release liner.

BACKGROUND OF THE INVENTION

It is a matter of common knowledge and experience to purchase rolls of vinyl or other plastic wallcoverings and to apply them as decorative surfaces by using modified pressure sensitive adhesives. See, for example, Sackoff, Smith and Walling, U.S. Pat. No. 4,151,319, and copending, Smith, U.S. Pat. application Ser. No. 08/043,388, filed on Apr. 6, 1993, both of which are assigned to the same assignee as the present application. Although embodiments are described in each which state that the laminate can be self wound after peeling the protective release sheet coated with adhesive, in general, these articles require removal of a carrier release liner as part of the application process, because after a few months of storage the rolls cannot be unwound without damaging their decorative surfaces.

It is also known to make cellulose fiber, i.e., paper based, wall coverings, adapted to be affixed to the surface to be decorated with pressure sensitive adhesives. For example, Rothenberg, U.S. Pat. No. 4,555,441, describes a self-adhesive wall covering in which a decorative fabric sheet is glued to an acrylic saturated paper, the wall-facing side of the paper opposite the fabric is coated with a pressure sensitive adhesive, and a release sheet is used to protect the adhesive until just before application to the wall, whereupon the release sheet is removed and discarded. Of special interest is the disclosure in Parkinson, Blakely and Russell, U.S. Pat. No. 3,620,366. Paper based coverings are said to be capable of being self wound and stored for months and yet unwound without damage to the decorative surface of the paper by using a protective coating of a synthetic resin on the decorative surface which acts as a release coat for the adhesive on the back surface. Such a construction obviously avoids the need to remove and discard a release paper during application. However, the exclusive use of cellulose based paper instead of vinyl or other moisture resistant substrates causes unique problems when attempts are made to use self wound rolls of wallcoverings of the type disclosed in the Parkinson et al patent. For example, the coverings are difficult to remove from the surface to be decorated (the "bonding substrate"), especially during the time shortly after application when repositioning is desirable; the normal hygro-expansivity-water is absorbed differentially into the cellulosic fibers resulting in corrugation and lifting from the bonding substrate; application difficulties are experienced, such as poor control of the adhesive properties, often resulting in premature bonding to the substrate or at times no adhesion at all; there is shrinkage, which in not experienced with plastic substrates. All of these drawbacks drive up the amount of waste produced and the cost.

These factors have forced manufacturers of paper wallcoverings to offer prepasted or 'apply your own paste' products. Such adhesives, however are generally water reactive cellulosic powders, starch, clay or polyvinyl acetate/polyvinyl alcohol blends which require major handling difficulties in term of application and removing of the product wallpaper from the bonding substrate. Typically these remoistenable adhesives are applied to a ground wood paper for economy, or to a more expensive latex saturated paper for improved durability and removeability. The other side is decorated with a print design and, perhaps, a ground coating to assist durability, print quality and washability of the product.

If, instead of remoistenable adhesives, attempts are made to substitute pressure sensitive adhesives in such constructions, the products fail because the pressure sensitive adhesives, without extreme modification, do not have adequate cohesive strength to resist the expansion and contraction of cellulosic fibers in the paper substrate which naturally inhale moisture from the surrounding atmosphere. Furthermore, the prior art's use of a barrier layer on one side (e.g., Parkinson et al), still does not solve this problem because the product does not possess the necessary repositionability and removability from the bonding substrate.

OBJECTS OF THE INVENTION

It is therefore an object of the invention to provide a paper based wallcovering which will not require pasting before applying to a wall and which will not require scraping from the wall when it is desired to redecorate.

It is a further object of the invention to provide self wound rolls of wallcoverings which can be stored for months, and remain stain-free, and yet which can be unwound without damage and affixed to a substrate to be decorated and exposed to environmental moisture without corrugating.

Various other objects, advantages and features of the present invention will be readily apparent from the ensuing detailed description, and the novel features will be particularly pointed out in the appended claims.

SUMMARY OF THE INVENTION

It has now been discovered that if a moisture barrier is placed on both sides of the paper substrate, and then a release agent is included in or coated on one side and a pressure sensitive adhesive coating is placed on the other side, then all of the above-mentioned drawbacks of paper based wall coverings using the conventional adhesives of the present state of the art, or the pressure sensitive adhesives of the prior art, are overcome. There is no longer any need to discard adhesive-protective sheets, the wallcoverings can be self-wound and unrolled after months of storage without damage, the coverings after application resist problems normally encountered when exposed to moisture normally in the surrounding air, and in preferred features the adhesives used permit repositionability during installation.

BRIEF DESCRIPTION OF THE DRAWING

The drawing shows in exploded schematic cross-section layers comprising the wallcovering of this invention. Shown are the essential features comprising two moisture barrier layers, each on opposite sides of the paper substrate, the uppermost of which also has release properties, and the lowermost of which also is elastomeric and, preferably, lacks a plastic memory, and a pressure sensitive layer as the bottom layer. Optional and preferred layers are also shown. The essential features provide the wallcovering with freedom for the cellulosic fibers to expand and contract as a function of the amount of incidental moisture in the surrounding atmosphere and to do this without differential forces occurring in the entire matrix. The optional layers provide decoration, stain resistance, improved interlaminar adhesion, and protective functionality.

DETAILED DESCRIPTION OF THE INVENTION

The advantageous properties described above are achieved by providing an article of manufacture comprising paper-based wallcovering for application to a wall to be decorated, the wallcovering comprising with reference to the Drawing: (i) paper substrate 4 having an outwardly facing surface and an inwardly facing surface, the paper substrate comprising cellulosic fibers, such as a ground wood stock and having a weight of between about 15 lbs and 125 lbs., preferably between 25 lbs and about 75 lbs per 3,000 square feet, and especially preferably 55 lbs per 3,000 square feet, (saturated paper, using styrene butadiene or acrylic coated paper can be used, but these are more expensive and are generally used for the strippable grades); (ii) optional decorative surface 2 (a) on the outwardly facing surface or (b) on optional ground coat layer 3 on the outwardly facing surface; (iii) transparent flexible layer 1 having moisture barrier and release properties on the outwardly facing surface of paper substrate 4 or on the optional decorative surfaces, layer 1 (iii) weighing between about 0.05 lbs, and 10.0 lbs., preferably between about 0.1 lbs and about 5.0 lbs per 3,000 square feet, especially preferably 0.5 lbs per 3,000 square feet and comprising a synthetic resin material of a type to be described; (iv) an optional elastomeric adhesive layer 5 on the inwardly facing surface comprising a pressure sensitive adhesive or a laminating adhesive, the layer being adapted to expand and contract with environmental moisture induced expansion and contraction of the cellulosic fibers in the paper substrate layer (i), layer 5 (iv) weighing between about 0.05 and 1.0 oz, preferably between about 0.1 oz and about 0.6 oz per yard, and especially preferably about 0.3 oz per yard and comprising a pressure sensitive adhesive of the type to be described that has been dried before laminating thus reducing the amount of moisture or solvent from entering the paper substrate; (v) flexible layer 6 having moisture barrier properties and no plastic memory (a) on the inwardly facing surface of the paper substrate 4 or (b) on the optional elastomeric layer 5 (iv), layer 6 (v) weighing between about 0.05 and about 2.0 oz, preferably between about 0.1 oz and about 1.0 oz per square yard, and especially preferably between 0.2 oz to 0.5 oz per square yard and comprising a synthetic resin material such as polypropylene, polyester, polyethylene, vinyl, polyurethane, and the like, preferably polyurethane, (the thickness can range from 0.1 milli-inches to 4 milli-inches the desired properties being enhanced at the higher thicknesses and preferably this layer will not have a plastic memory but yet is elastomeric. Generally these barrier films are cast coated, or transfer coated, e.g., from a plastisol, or solution or emulsion of an acrylic or urethane composition and therefore they do not have an inherent memory that so typifies calendared plastics such as poly(vinyl chloride); and (vi) layer 7 of a tacky pressure sensitive adhesive on the surface of flexible barrier layer 6(v), the adhesive being adapted to affix the wallpaper repositionably to the wall with low zero peel strength which increases to a maximum bonding strength of not in excess of about 1,000 g per inch pull adhesion on a conventionally acrylic painted wall board and layer 7 (vi) being present in an amount of between about 0.3 oz and about 0.9 oz per square yard, preferably about 0.6 oz per square yard.

A preferred embodiment of the invention comprises providing a wallcovering as defined above in the form of a self-wound roll, the roll including a plurality of turns of the wallcovering, flexible release layer 1 (iii) on one turn contacting pressure-sensitive adhesive layer 7 (vi) on an adjacent turn, and release layer 1 (iii) on the one turn being readily separable from the tacky pressure-sensitive adhesive layer 7 (vi) on the adjacent turn, whereby the roll may be unrolled without delamination of the wallcovering.

The purpose of the pressure-sensitive adhesive is to enable the paper to be stuck to the wall, ceiling, or the like, and yet to permit removal of the paper by merely pulling the paper from the wall. Although the coating of pressure-sensitive adhesive should be such as to provide an adhesive to wall bond of sufficient strength for the paper to remain in position without spontaneous peeling for the useful life of the wallpaper, yet the adhesive strength of the adhesive to wall bond should not be greater than either the cohesive strength of the adhesive or the adhesive to paper bond, and these, in turn, should preferably not be greater than either the laminar or tear strength of the paper. The object of these requirements is to ensure that the paper can be removed from the wall before redecoration without delaminating or tearing, and to leave as little adhesive as possible on the wall. However, it is also necessary that, after the wallcovering has been reeled up after manufacture but before use, the adhesive layer should not pull off any of the printed surface of the paper or transfer onto that surface upon unreeling, thus the force necessary to separate on unreeling should be less than the forces necessary to cause delamination of the coating on the printed paper or for pulling away of the ground and print coats from the base paper.

These properties may be achieved by using a variety of combinations of barrier and protective and release treated coatings and adhesives and modified adhesives. In general most of the coatings may be obtained from emulsions or solutions of the following types: emulsion copolymers of vinylidene chloride and one or more acrylic esters, copolymers of styrene and one or more acrylic esters, plasticized polyvinyl acetate, vinyl acetate copolymers, acrylic ester polymers or copolymers and copolymers of butadiene with styrene, acrylonitrile or methyl methacrylate, solutions or dispersions of water soluble polyesters, water-dispersible polyurethanes, and the like. Suitable acrylic esters include the alkyl acrylates and methacrylates, such as methyl acrylate, ethyl acrylate, propyl acrylate, iso-propyl acrylate, butyl acrylate, t-butyl acrylate, hexyl acrylate, heptyl acrylate, 2-ethyl hexyl acrylate, decyl acrylate, dodecyl acrylate, methyl methacrylate, ethyl methacrylate, n-butyl methacrylate and the like. The vinylidene chloride/acrylic ester copolymers may contain up to 75 percent by weight of vinylidene chloride; thus copolymers of 60 to 75 percent by weight of vinylidene chloride and 25 to 40 percent by weight of ethyl acrylate and especially a copolymer of 70 percent vinylidene chloride and 30 percent ethyl acrylate in emulsion form are useful. Such vinylidene chloride copolymers have a minimum film-forming temperature greater than room temperature (i.e. greater than 20° C.) and exhibit a glass transition temperature of at least 25° C. Similarly emulsion copolymers of styrene and one or more acrylic esters, for example a copolymer containing 40 to 60 percent by weight of styrene and 40 to 60 percent by weight of butyl acrylate can also be used. A preferred copolymer emulsion is a copolymer of equal parts by weight of styrene and butyl acrylate. In such styrene/acrylic ester copolymers, the greater the styrene content the greater the proportion of long chain alkyl ester that is necessary in the acrylic ester component in order to provide the desirable value for the minimum film-forming temperature of greater than 20° C. As an example of another copolymer that may be used, mention is made of a copolymer of 60–40 percent by weight of methyl methacrylate and 40–60 percent by weight of ethyl acrylate. A release agent such as a wax or silicone emulsion, may be added to the polymer or copolymer emulsion, particularly when the minimum film-forming temperature of the polymer or copolymer is less than about 20° C. In an alternative procedure, the decorative surface may be given a first coating of one of the polymers or copolymers described above and then this first coating (after drying) may be given a lightweight coating of a release agent such as a wax or silicone emulsion. In addition there may be used for the coatings certain mixtures of synthetic emulsions with other materials such as are described in Parkinson et al's U.K. Pat. No. 1,157,040 which discloses a transparent coating composition for application to a base material of wallpaper to give a matt finish comprising a synthetic polymer, capable of giving a transparent flexible nonblocking film, in the form of an emulsion or latex, the polymer being present in an amount of the total dry weight content of between 45 and 95 percent, a polysaccharide which is only partially soluble in cold water in an amount of between 1 and 40 percent of the total dry weight content and a mineral filler in an amount of between 1 and 30 percent of the total dry weight content. A typical synthetic polymer emulsion for use in the transparent coating composition of U.K. Pat. No. 1,157,040 is a polyvinyl acetate emulsion at 55 percent solids content plasticized to give 10 percent of plasticizer on polymer weight the plasticizer being di-isobutyl phthalate. Also useful, and preferred, are water-dispersible resins of the type described in German Published Patent Application Nos. 2141805 and 2141807 and U.S. Pat. Nos. 3,905,929 and 5,043,381.

The coating weight of the layers needed to provide the desired properties in the end products may vary from paper to paper, but it is essential to apply sufficient to form a continuous coating on the decorative surface which is substantially free of "pinholes." Generally speaking satisfactory results can be obtained on nonembossed papers using coating weights as specified above. Also, higher coating weights may be needed for a barrier coat on an embossed paper than for a paper that is only printed even though made from the same paper substrate.

The tacky pressure-sensitive adhesive material may be any material which will give adequate adhesion to the wall and yet will permit both easy unreeling of the rolls and removal of the paper from walls by peeling. Materials which may be used include synthetic and natural rubbers (usually compounded with a tackifying resin), polyisobutylene, polyvinyl alkyl ethers and vinyl acetate copolymers and acrylic ester polymers and copolymers thereof. These adhesives may be applied in the form of solvent based solutions or emulsions though clearly the use of the emulsion form is advantageous due to the cost and fire hazards associated with the use of solvents.

The preferred adhesive is an acrylic ester polymer or copolymer emulsion because of the superior resistance to degradation and consequent freedom from changes in adhesive properties on ageing. Typical emulsions suitable for use to obtain in the adhesive coating include emulsions of butyl acrylate or copolymers of 2-ethylhexyl acrylate and/or heptyl acrylate and methyl methacrylate containing at least 80 percent (and preferably at least 90 percent) by weight of 2-ethyl-hexyl acrylate and/or heptyl acrylate and of copolymers of vinyl acetate and 2-ethyl-hexyl acrylate and/or heptyl acrylate containing 30 to 95 percent by weight of the acrylic ester.

The most preferred adhesives are those of the type mentioned above to which there is added a material which produces a low zero-minute peel value. This permits the wallcovering to be easily applied to a substrate and removed and repositioned or straightened, if necessary, and provides an increase in peel value over a period of time to produce a more permanent installation. Such adhesive and the additive, usually a silicone compound of a specified type are described in the above-mentioned Sackoff, et al patent, U.S. Pat. No. 4,151,319. The most preferred embodiments use a pressure sensitive adhesive of the type specified in the above-mentioned copending Smith patent application which comprises a pressure sensitive adhesive of the type described above modified with a zero peel additive which comprises an effective amount of an admixture of polysiloxanes (i) and (ii), the polysiloxane (i) being substantially water-insoluble and insoluble in the pressure sensitive adhesive and formed from monomeric units having structures (I) and (II) as follows:

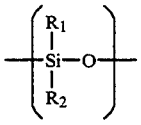

(I)

and

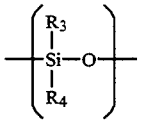

(II)

wherein $R_1$ is methyl, ethyl, phenyl, tolyl, or a mixture of any of them, $R_2$ is methyl, ethyl or phenyl; and $R_3$ and $R_4$ are the same or different and are methyl or ethyl, wherein the majority of units (I) and (II) comprise units (II), and said polysiloxane (i) has a viscosity in the range of from 5 cps to 60,000 cps measured at 25° C. with a #4 spindle at 30 rpm; and the polysiloxane (ii) being water-soluble and compatible with polysiloxane (i) and formed from monomeric units having structures (Ia) and (IIa) as follows:

(Ia)

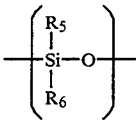

and (IIa)

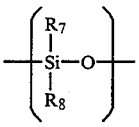

wherein $R_5$ is a polyoxyalkylene group having the structural formula $$-R_9(OC_2H_4)_n(OC_3H_6)_mOR_{10}$$

wherein $R_{10}$ is hydrogen or a monovalent hydrocarbon group having from 1 to 10 carbon atoms and contains both oxyethylene and oxypropylene units, $R_9$ is an alkylene group having at least two carbon atoms, n and m are numbers, the sum of n and m is at least 1 and the oxyalkylene unit $R_{10}(OC_3H_6)_m(C_2H_4)_n$, has a molecular weight of at least about 80, and wherein there are at least two units having structure (Ia) and at least three units having structure (IIa) and wherein the oxyalkylene unit constitutes from about 85 to 30 weight percent of the polysiloxane polymer; $R_6$ may be methyl, ethyl, or phenyl; and $R_7$ and $R_8$ may the same or different and may be methyl or ethyl, and said polysiloxane (ii) has a viscosity in the range of from 50 to 5000 cps measured at 25° C. with a #4 spindle at 30 rpm, the amount of polysiloxane (i) in said admixture being effective to separate from the adhesive and to bloom to the adhesive/air interface of an article coated with said adhesive composition to provide efficient repositionability and the amount of polysiloxane (ii) in the admixture being effective to provide faster wet-out of the adhesive to a bonding substrate and, ultimately, superior adhesion thereto. Methods to obtain the preferred pressure sensitive adhesives will be given in the examples which follow.

The paper used for the substrates may be composed of bound fibers of many substances, but predominantly cellulose, in sheet form. While the most common paper used is made from mechanical pulp, or groundwood, paper made from chemical pulp may also be used but, where greater strength is required, only a minor part of these fibers may be replaced with stronger fibers made from materials such as are used for making textiles. Such fibers may be derived from regenerated cellulose, e.g. rayon or cellulose acetate, may be entirely synthetic in nature, e.g. polyamide and polyester fibers, or they may be inorganic fibers such as glass. An alternative method to obtain greater strength is to impregnate paper with resins such as styrene-butadiene or acrylic ester copolymer emulsions. Generally speaking papers especially suitable for the manufacture of wallpaper weigh between 55 and 75 lbs per 3,000 square feet. although they can be heavier or lighter, as mentioned above. Such modifications are not preferred, however, because they increase the cost of the ultimate products.

If desired, the paper substrate may be printed or otherwise decorated, for example, by embossing so as to provide a decorative surface.

DESCRIPTION OF THE PREFERRED EMBODIMENTS

The invention is illustrated by the following examples in which parts are by weight.

EXAMPLE 1

A roll of printed wallpaper made using as a substrate a paper derived from mechanical pulp or groundwood weighing 55 lbs per 3,000 square feet and obtained from a commercial source already barrier coated on one side with polyvinyl chloride is printed and then coated on the printed surface with a resin emulsion containing 50 percent solids of a copolymer of 70 weight percent vinylidene chloride and 30 weight percent ethyl acrylate and then with a silicone release composition giving a light release coating over the barrier coating and the print after drying in a tunnel dryer at 100° C. The coating weight of this release layer is found to be 0.5 to 2.0 lbs per 3,000 square feet. The paper is then coated on its other or back surface first with an acrylic pressure sensitive adhesive consisting of a 50 percent solids synthetic resin emulsion of a copolymer containing 95 percent 2-ethyl hexyl acrylate and 5 percent methyl methacrylate at a coating weight of 0.3 oz per yard using the same coating and drying techniques as described above, and then a polyurethane cast coated barrier film comprising an aqueous solution of a heat curable polyurethane is deposited to a thickness of about 0.25–0.5 milliinches, dry, onto the adhesive layer and dried and cured at 100° C. This layer is elastomeric, having a elongation to break of 400%, and a tensile strength of 4,000 psi. The polyurethane solution from which the coating is prepared can be obtained in ways well known to those skilled in this art, e.g., by reacting a trifunctional isocyanate prepolymer with a monofunctional polyethylene oxide ether to produce a difunctional product which is dispersed in water and reacted with a difunctional chain extender, for example a diamine, to form a polyurethane of nonionic, but water-dispersible characteristics. See, for example, the patents mentioned above. On the polyurethane barrier coating is applied a layer of an acrylic pressure sensitive adhesive containing a mixture of silicones to a dry coating weight of 0.6 oz per square yard. The composition for this coating is made in accordance with U.S. patent application Ser. No. 08/043,388, Example 1:

A dimethylsiloxane homopolymer having a viscosity of about 1,000 to 3,000 cps. (#4 spindle at 30 rpm) is mixed at a 1 to 1 weight ratio with a dimethylsiloxaneoxyalkylene block copolymer containing oxyethylene and oxypropylene units and having a viscosity of about 2,250 cps. (#4 spindle at 30 rpm) to produce an admixture which is suspended in water with a propeller type stirrer to form a composition having a ratio of polysiloxane admixture to water of about 1 to 3, respectively, by weight. This solution is slowly added to a butyl acrylate homopolymeric pressure sensitive adhesive having a solids content of about 50% by weight, a viscosity of about 480 cps. (#3 spindle at 60 rpm) and a plasticity of about 1.8 mm contained in a suitable vessel fitted with a double blade mixer. The concentration of polysiloxane admixture in the pressure sensitive adhesive is 0.2% by weight based on the solids content of the adhesive. The contents of the vessel are then mixed by the double blade mixer at 60–65 rpm for 16 hours and the resulting mixture is coated onto the polyurethane layer by reverse roll coating and dried at 100° C. yielding a coating weight of 0.6 oz per square yard.

The wallcovering made by this example is reeled up and part of it unreeled and applied to a wall.

After storing the remainder of the wallcovering under its own weight for a period of several weeks it is unreeled. The reels unwind very easily, and the printed surface is not damaged. The paper is also tested in a relative humidity chamber in which the relative humidity is successively increased from 15% to 50% and finally to 98%. It is observed that even at the highest humidities, the paper remains firmly adhered to a substrate with little or no lifting even by moisture which may come in from the exposed edges. The example shows that, using the paper, resins and conditions described a very useful wallcovering is obtained.

COMPARATIVE EXAMPLE 1A

The same barrier coated paper as was used in Example 1 is coated on the printed side, using the same method as described in that example with the same release resin emulsion.

The paper is then coated on its other or back surface with the same pressure sensitive adhesive coating used in Example 1, but in this instance the polyurethane elastomeric cast coated barrier layer is omitted.

Using this system it was found that paper has adequate adhesion to a wall, but once affixed stains are observed on the decorated face and it cannot easily be peeled off after remaining in position for several months and moreover can be unreeled without damaging the printed surface after standing stacked in rolls for a period of several weeks, but, because it imbibes water (the humidity chamber test shows lift off by moisture entering from the sides at higher humidities), it should be stored in a sealed container and it will wrinkle on the wall when exposed to moisture.

EXAMPLE 3

Wallpaper was prepared and tested exactly as described in example (1) except that in this case a cast coated polyester layer is used instead of the polyurethane layer. The pressure-sensitive adhesive coating used on the back surface is obtained from a 50 percent solids copolymer emulsion containing 90 percent 2-ethyl-hexyl acrylate and 10 percent of methyl methacrylate. In this case, because a zero peel strength modifier is not used, it was found that the application work must be carefully done to avoid repositioning. The paper can however be rolled and unwound without damage to the decorative surface and the decorated wall can be exposed to moisture without adverse effect. Stripping after several months can be accomplished without any problem.

EXAMPLE 4

Wallpaper is prepared and tested exactly as in Example 1 except that the barrier film with elastomeric properties comprises a 0.2 milli-inch thick polyurethane film cast coated onto a polypropylene film and then transfer coated from the polypropylene (which is recycled) and bonded under heat and pressure directly to the back surface of the paper substrate. Substantially the same results are obtained.

EXAMPLE 5

A roll of printed wallpaper, the paper substrate of which contains 30 percent rayon fibers and 70 percent groundwood, and weighs 55 lbs per 3,000 square feet is coated and tested exactly as in Example 1 with the same barrier layers and adhesive emulsion systems on the printed surface and the back surface, respectively. The amount of adhesive required to obtain adequate adhesion and unreeling properties are the same, but this paper has improved strength making stripping from walls even more easy than with other examples described in this specification.

The above-identified patents and application are incorporated herein by reference.

Many variations of the present invention will suggest themselves to those skilled in this art in light of the above, detailed description. For example, instead of a silicone release composition, release properties can be achieved with natural and/or synthetic waxes. The outer release/barrier layer can comprise a copolymer of styrene and butyl acrylate in admixture with a silicone material, and the polyvinylchloride moisture barrier layer on the surface of the paper can be omitted. The decorative printing can be omitted or replaced with a solid colored pigmented layer. Instead of an optional pressure sensitive layer or laminating layer of the paper, a remoistenable adhesive layer , such as a polyvinyl alcohol/acetate layer, can be used; this has the desirable function of picking up moisture or giving it up thus helping to maintain the wallcovering in place after installation. In all cases, however, the variations must provide that a moisture barrier is present on both sides of the paper so that the cellulosic fibers have the freedom to expand and contract as a function of incidental moisture from the surrounding atmosphere and to do this without differential forces occurring in the entire matrix. All such obvious variations are within the full intended scope of the appended claims.

What I claim and desire to secure by Letters Patent is:

1. An article of manufacture comprising paper-based wallcovering for application to a wall to be decorated, said wallcovering comprising (i) a paper substrate having an outwardly facing surface and an inwardly facing surface, said paper substrate comprising cellulosic fibers and having a weight of between about 15 lbs and about 125 lbs per 3,000 square feet;

(ii) an optional decorative surface (a) attached to said outwardly facing surface or (b) attached to an optional ground coat layer on said outwardly facing surface;

(iii) a transparent flexible layer having moisture barrier and release properties attached to said outwardly facing surface of said paper substrate or attached to said optional decorative surfaces, said layer weighing between about 0.05 lbs and about 10.0 lbs per 3,000 square feet and comprising a synthetic resin material;

(iv) an optional elastomeric adhesive layer adhered to said inwardly facing surface comprising a pressure sensitive adhesive, a remoistenable adhesive or a laminating adhesive, said layer expands and contracts with environmental moisture induced expansion and contraction of the cellulosic fibers in said paper substrate layer (i), said layer weighing between about 0.05 oz and about 1.0 oz per yard;

(v) a flexible layer having moisture barrier properties (a) attached to said inwardly facing surface of said paper substrate or (b) adhered to said optional elastomeric layer (iv), said layer weighing between about 0.05 oz and about 2.0 oz per square yard and consisting of a synthetic resin material; and (vi) a layer of a tacky pressure sensitive adhesive adhered to the surface of flexible barrier layer (v), said adhesive being adapted to affix said wallpaper repositionably to said wall with zero peel strength which increases to a maximum bonding strength of not in excess of about 1,000 g per inch pull adhesion on a conventionally acrylic painted wall board and being present in an amount of between about 0.3 oz and about 0.9 oz per square yard.

2. An article of manufacture comprising paper-based wallcovering in the form of a self-wound roll for application to a wall to be decorated, said wallcovering comprising (i) a paper substrate having an outwardly facing surface and an inwardly facing surface, said paper substrate comprising cellulosic fibers and having a weight of between about 15 lbs and about 125 lbs per 3,000 square feet;

(ii) an optional decorative surface (a) attached to said outwardly facing surface or (b) attached to an optional ground coat layer on said outwardly facing surface;

(iii) a transparent flexible layer having moisture barrier and release properties attached to said outwardly facing surface of said paper substrate or attached to said optional decorative surfaces, said layer weighing between about 0.05 lbs and about 10.0 lbs per 3,000 square feet and comprising a synthetic resin material;

(iv) an optional elastomeric adhesive layer adhered to said inwardly facing surface comprising a pressure sensitive adhesive, a remoistenable adhesive or a laminating adhesive, said layer expands and contracts with environmental moisture induced expansion and contraction of the cellulosic fibers in said paper substrate layer (i), said layer weighing between about 0.05 oz and about 1.0 oz per yard;

(v) a flexible layer having moisture barrier properties (a) attached to said inwardly facing surface of said paper substrate or (b) adhered to said optional elastomeric layer (iv), said layer weighing between about 0.05 oz and about 2.0 oz per square yard and consisting of a synthetic resin material; and (vi) a layer of a tacky pressure sensitive adhesive adhered to the surface of flexible barrier layer (v), said adhesive being adapted to affix said wallpaper repositionably to said wall with zero peel strength which increases to a maximum bonding strength of not in excess of about 1,000 g per inch pull adhesion on a conventionally acrylic painted wall board and being present in an amount of between about 0.3 oz and about 0.9 oz per square yard, said roll including a plurality of turns of said wallcovering, said transparent, flexible release layer (iii) on one turn contacting the pressure-sensitive adhesive layer (vi) on an adjacent turn, and the release layer (iii) on said one turn being readily separable from the tacky pressure-sensitive adhesive layer (vi) on said adjacent turn, such that said roll may be unrolled without delamination of said wallcovering.

3. Wallcovering as defined in claim 1, wherein said moisture-barrier and release layer (iii) has a matte or gloss finish and comprises a synthetic polymer or copolymer having a minimum film-forming temperature below about 20° C. in admixture with a release agent of natural waxes, synthetic waxes or silicones.

4. Wallcovering as defined in claim 3, wherein said synthetic resin material in layer (iii) comprises the residue obtained by drying a composition comprising (a) an emulsion of copolymers of vinylidene chloride and one or more acrylic esters, copolymers of styrene and one or more acrylic esters, plasticized polyvinyl acetate, vinyl acetate copolymers, acrylic ester polymers, acrylic ester copolymers, copolymers of styrene and butadiene, copolymers of styrene and acrylonitrile, copolymers of styrene and methyl methacrylate, resins comprising a polyester or a polyurethane, mixtures of any of the foregoing, and (b) a small, amount of from about 0.001 to about 20 percent based on the solids content of the pressure sensitive adhesive of a release agent comprising a silicone, a natural wax, a synthetic wax, or a mixture of any of the foregoing.

5. An article of manufacture comprising paper-based wallcovering for application to a wall to be decorated, said wallcovering comprising (i) a paper substrate having an outwardly facing surface and an inwardly facing surface, said paper substrate comprising cellulosic fibers and having a weight of between about 15 lbs and about 125 lbs per 3,000 square feet;

(ii) an optional decorative surface (a) attached to said outwardly facing surface or (b) attached to an optional ground coat layer on said outwardly facing surface;

(iii) a transparent flexible layer having moisture barrier and release properties attached to said outwardly facing surface of said paper substrate or attached to said optional decorative surfaces, said layer weighing between about 0.05 lbs and about 10.0 lbs per 3,000 feet and comprising a synthetic resin material;

(iv) an optional elastomeric adhesive layer adhered to said inwardly facing surface comprising a pressure sensitive adhesive, a remoistenable adhesive or a laminating adhesive, said layer expands and contracts with environmental moisture induced expansion and contraction of the cellulosic fibers in said paper substrate layer (i), said layer weighing between about 0.05 oz and about 1.0 oz per yard;

(v) a flexible layer having moisture barrier properties (a) attached to said inwardly facing surface of said paper substrate or (b) adhered to said optional elastomeric layer (iv), said layer weighing between about 0.05 oz and about 2.0 oz per square yard and consisting of a synthetic resin material; and (vi) a layer of a tacky pressure sensitive adhesive adhered to the surface of flexible barrier layer (v), said adhesive being adapted to affix said wallpaper repositionably to said wall with zero peel strength which increases to a maximum bonding strength of not in excess of about 1,000 g per inch pull adhesion on a conventionally acrylic painted wall board and being present in an amount of between about 0.3 oz and about 0.9 per square yard, wherein said moisture barrier and release layer (iii) has a matte or gloss finish and comprises a synthetic copolymer having a minimum film-forming temperature below about 20° C. in admixture with a release agent, said layer comprising the residue obtained by drying a composition comprising (a) an emulsion of a copolymer of about 50 percent by weight of styrene and about 50 percent by weight of butyl acrylate in admixture with (b) a small, amount of from about 0.001 to about 20 percent based on the solids content of the pressure sensitive adhesive of a release agent comprising a silicone material.

6. Wallcovering as defined on claim 1, wherein said optional ground coat layer (ii)(b) comprises a vinyl latex coating, a vinyl plastisol, or an acrylic resin coating and said coating weighs from about 5 lbs to about 70 lbs per 3,000 square feet.

7. Wallcovering as defined in claim 1 wherein said tacky pressure-sensitive adhesive (vi) comprises an effective amount of an admixture of polysiloxanes (i) and (ii), said polysiloxane (i) being substantially water-insoluble and insoluble in said pressure sensitive adhesive and formed from monomeric units having structures (I) and (II) as follows:

(I)

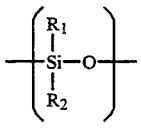

and (II)

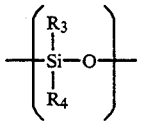

wherein $R_1$ is methyl, ethyl, phenyl, tolyl, or a mixture of any of them, $R_2$ is methyl, ethyl or phenyl; and $R_3$ and $R_4$ are the same or different and are methyl or ethyl, wherein the majority of units (I) and (II) comprise units (II), and said polysiloxane (i) has a viscosity in the range of from 5 cps to 60,000 cps measured at 25° C. with a #4 spindle at 30 rpm; and said polysiloxane (ii) being water-soluble and compatible with polysiloxane (i) and formed from monomeric units having structures (Ia) and (IIa) as follows:

(Ia)

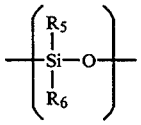

and

-continued (IIa)

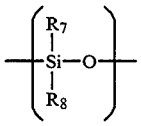

wherein $R_5$ is a polyoxyalkylene group having the structural formula $$-R_9(OC_2H_4)_n(OC_3H_6)_mOR_{10}$$

wherein $R_{10}$ is hydrogen or a monovalent hydrocarbon group having from 1 to 10 carbon atoms and contains both oxyethylene and oxypropylene units, $R_9$ is an alkylene group having at least two carbon atoms, n and m are numbers, the sum of n and m is at least 1 and the oxyalkylene unit $R_{10}(OC_3H_6)_m(C_2H_4)_n$, has a molecular weight of at least about 80, and wherein there are at least two units having structure (Ia) and at least three units having structure (IIa) and wherein the oxyalkylene unit constitutes from about 85 to 30 weight percent of the polysiloxane polymer; $R_6$ may be methyl, ethyl, or phenyl; and $R_7$ and $R_8$ may the same or different and may be methyl or ethyl, and said polysiloxane (ii) has a viscosity in the range of from 50 to 5000 cps measured at 25° C. with a #4 spindle at 30 rpm, the amount of polysiloxane (i) in said admixture being effective to separate from the adhesive and to bloom to the adhesive/air interface of an article coated with said adhesive composition to provide efficient repositionability and the amount of polysiloxane (ii) in said admixture being effective to provide faster wet-out of the adhesive to a bonding substrate and, ultimately, superior adhesion thereto.

8. A wallcovering as defined in claim 7, wherein said pressure-sensitive adhesive comprises the residue obtained by drying an emulsion of natural and synthetic rubbers, polyisobutylene, polyvinyl alkyl ethers, vinyl acetate copolymers, acrylic ester polymers or acrylic ester copolymers.

9. Wallcovering as defined in claim 7, wherein the amount of admixed polysiloxanes (i) and (ii) present is in the range from about 0.001 to 20 percent based on the solids content of the pressure sensitive adhesive.

10. Wallcovering as defined in claim 1, wherein said flexible layer having moisture barrier properties (v) selected from the group consisting of polypropylene, polyethylene, poly(vinyl chloride), polyacrylate, polyester, polyurethane, and a copolymer of any of the foregoing.

11. Wallcovering as defined in claim 10, wherein said flexible barrier film layer (v) is a cast-coated or a transfer-coated layer.

12. Wallcovering as defined in claim 11, said layer (v) consists of a polyurethane or polyester cast coated or transfer coated film at a weight of from about 0.2 oz to about 0.5 oz per yard.

* * * * *